US010274879B2

(12) United States Patent
Ishiguro

(10) Patent No.: US 10,274,879 B2
(45) Date of Patent: Apr. 30, 2019

(54) IMAGE FORMING APPARATUS

(71) Applicant: CANON KABUSHIKI KAISHA, Tokyo (JP)

(72) Inventor: Keita Ishiguro, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/683,100

(22) Filed: Aug. 22, 2017

(65) Prior Publication Data

US 2018/0059593 A1 Mar. 1, 2018

(30) Foreign Application Priority Data

Aug. 23, 2016 (JP) ..... 2016-162560

(51) Int. Cl.
*G03G 15/20* (2006.01)
*G03G 15/00* (2006.01)

(52) U.S. Cl.
CPC ..... *G03G 15/2053* (2013.01); *G03G 15/55* (2013.01)

(58) Field of Classification Search
CPC ..... G03G 15/2053
See application file for complete search history.

(56) References Cited

U.S. PATENT DOCUMENTS 8,457,512 B2 * 6/2013 Seol ..... G03G 15/206 399/122
2012/0177388 A1 * 7/2012 Imada ..... G03G 15/2053 399/33
2015/0160595 A1 * 6/2015 Tamada ..... G03G 15/2053 399/329
2016/0274511 A1 * 9/2016 Ogino ..... G03G 15/2053

FOREIGN PATENT DOCUMENTS

JP 2008-083091 A 4/2008

* cited by examiner

*Primary Examiner* — David M. Gray
*Assistant Examiner* — Michael A Harrison
(74) *Attorney, Agent, or Firm* — Venable LLP

(57) ABSTRACT

An image forming apparatus includes an image forming portion configured to form a toner image on a recording material; an endless belt and a roller which are configured to form a nip therebetween for fixing, on the recording material, the toner image formed by the image forming portion; a pad configured to urge the endless belt from an inside of the endless belt toward the roller; a motor configured to drive the roller; an acquiring portion configured to acquire a starting torque when rotation of the roller is started; and a discriminating portion configured to discriminate a lifetime of the endless belt depending on the starting torque acquired by the acquiring portion.

7 Claims, 14 Drawing Sheets

(a) NORMAL (50mm/sec SETTING)

(b) NOISE (50mm/sec SETTING)

| TEMP. (℃) | 10 | 25 | 35 | 100 | 180 | 200 |
|---|---|---|---|---|---|---|
| T. C. C. | 1.6 | 1 | 0.83 | 0.5 | 0.32 | 0.3 |

Fig. 13

IMAGE FORMING APPARATUS

FIELD OF THE INVENTION AND RELATED ART

The present invention relates to an image forming apparatus such as a copying machine, a printer, a facsimile machine or a multi-function machine having a plurality of functions of these machines.

Conventionally, the image forming apparatus forms an unfixed toner image on a recording material by an image forming process including charging, exposure, development and transfer, and fixes the toner image on the recording material by subjecting the toner image to a heating and pressing process by a fixing device.

As an example of the fixing device, there is a fixing device of a belt type including a pair of rotatable members, one being an endless belt and the other being a roller.

In the belt type, the endless belt is pressed (urged) by a pad, and therefore, the endless belt tends to be abraded by friction with the pad.

When the abrasion of the endless belt progresses, there is a liability of generation of noise with the friction.

For that reason, conventionally, before such a situation occurs, a discriminating portion discriminates that the endless belt reaches an end of a lifetime thereof, and then a service person performs maintenance of the fixing device.

Specifically, in an image forming apparatus disclosed in Japanese Laid-Open Patent Application 2008-083091, a torque of a driving motor in a start in which rotation of the driving motor is stable is detected and then a lifetime of a fixing device is estimated.

However, there is a liability that noise generates irrespective of an absolute value of a driving torque, so that there is room for improvement.

SUMMARY OF THE INVENTION

According to an aspect of the present invention, there is provided an image forming apparatus comprising: an image forming portion configured to form a toner image on a recording material; an endless belt and a roller which are configured to form a nip therebetween for fixing, on the recording material, the toner image formed by the image forming portion; a pad configured to urge the endless belt from an inside of the endless belt toward the roller; a motor configured to drive the roller; an acquiring portion configured to acquire a starting torque when rotation of the roller is started; and a discriminating portion configured to discriminate a lifetime of the endless belt depending on the starting torque acquired by the acquiring portion.

According to another aspect of the present invention, there is provided an image forming apparatus comprising: an image forming portion configured to form a toner image on a recording material; an endless belt and a roller which are configured to form a nip therebetween for fixing, on the recording material, the toner image formed by the image forming portion; a pad configured to urge the endless belt from an inside of the endless belt toward the roller; a motor configured to drive the roller; an acquiring portion configured to acquire a starting torque when rotation of the roller is started; and a notifying portion configured to provide notification of prompting of exchange of the endless belt depending on the starting torque acquired by the acquiring portion.

According to another aspect of the present invention, there is provided an image forming apparatus comprising: an image forming portion configured to form a toner image on a recording material; a fixing portion including an endless belt and a roller which are configured to form a nip therebetween for fixing, on the recording material, the toner image formed by the image forming portion; a pad configured to urge the endless belt from an inside of the endless belt toward the roller; a motor configured to drive the roller; an acquiring portion configured to acquire a starting torque when rotation of the roller is started; and a discriminating portion configured to discriminate a lifetime of the fixing portion depending on the starting torque acquired by the acquiring portion.

According to a further aspect of the present invention, there is provided an image forming apparatus comprising: an image forming portion configured to form a toner image on a recording material; a fixing portion including an endless belt and a roller which are configured to form a nip therebetween for fixing, on the recording material, the toner image formed by the image forming portion; a pad configured to urge the endless belt from an inside of the endless belt toward the roller; a motor configured to drive the roller; an acquiring portion configured to acquire a starting torque when rotation of the roller is started; and a discriminating portion configured to provide notification of prompting of exchange of the fixing portion depending on the starting torque acquired by the acquiring portion.

Further features of the present invention will become apparent from the following description of exemplary embodiments with reference to the attached drawings.

Figure 4:
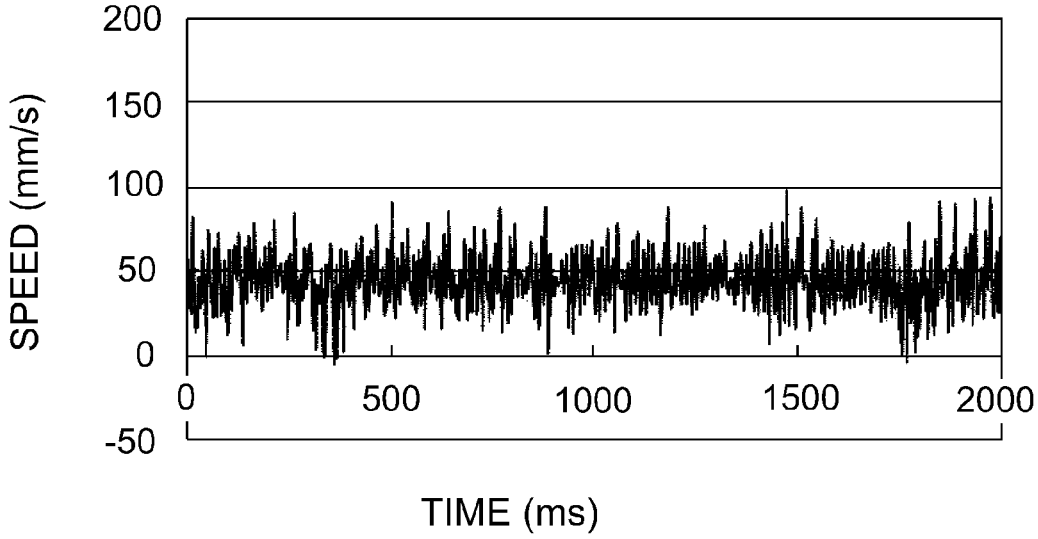
Figure 4:
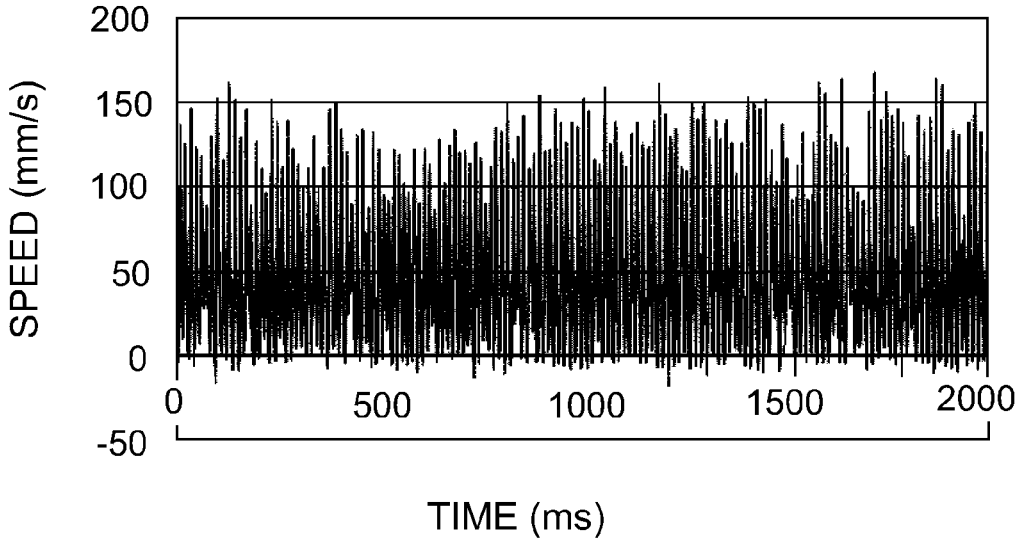

Parts (a) and (b) of FIG. 4 are comparison diagram of a belt feeding direction speed during steady-state drive and during generation of noise of stick-slip, respectively.

Figure 5:
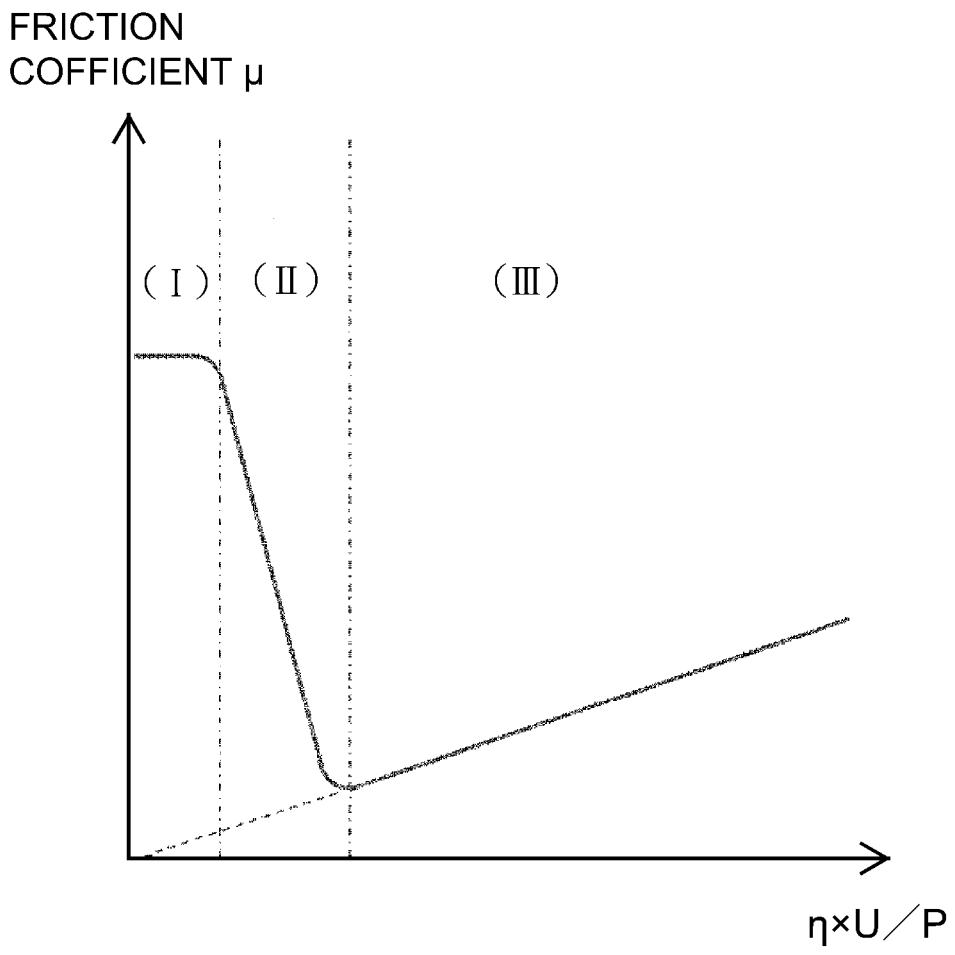

FIG. 5 is a graph for illustrating a Stribeck curve.

Figure 6:
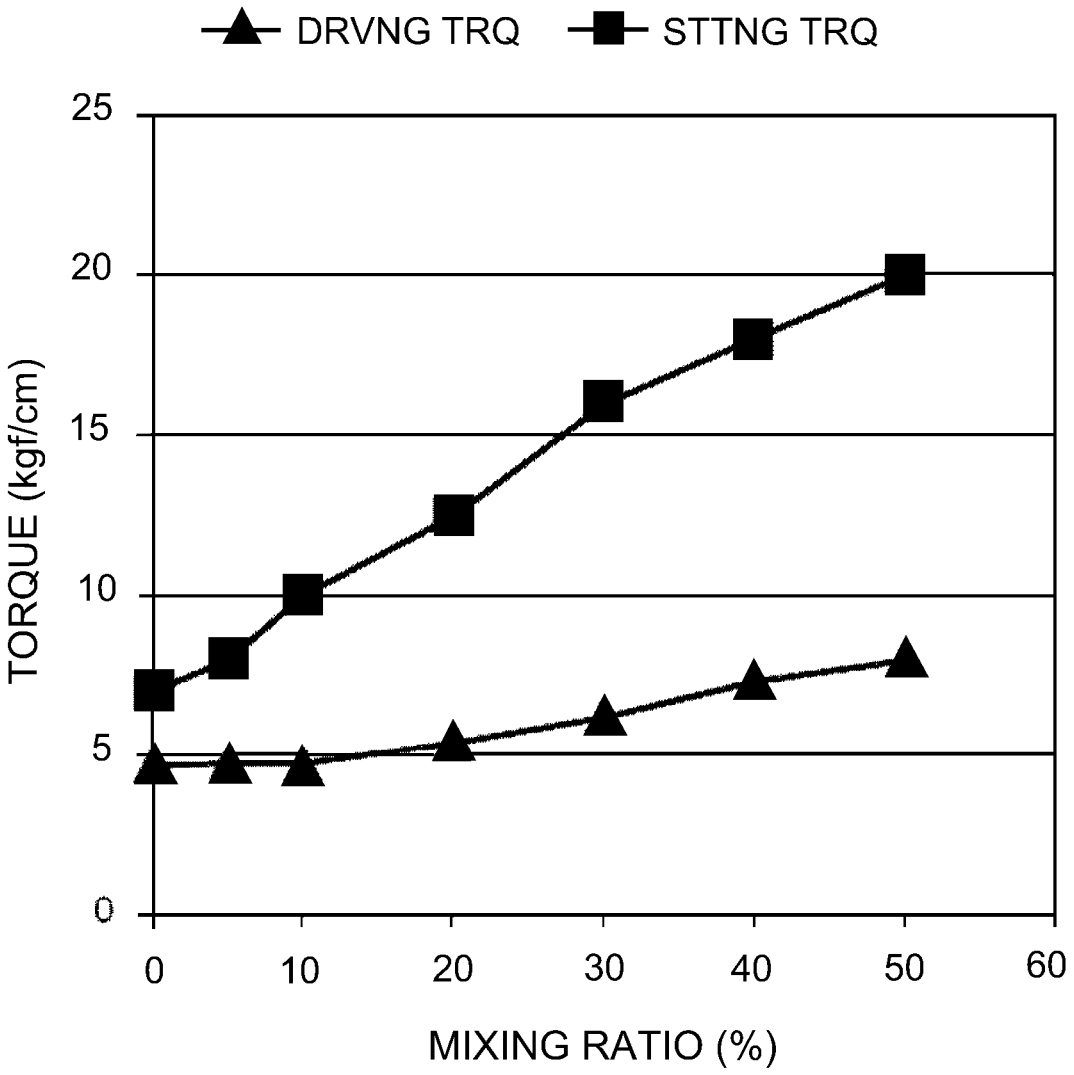

FIG. 6 is a graph showing a relationship between a foreign matter inclusion amount and a rotational torque.

Figure 7:
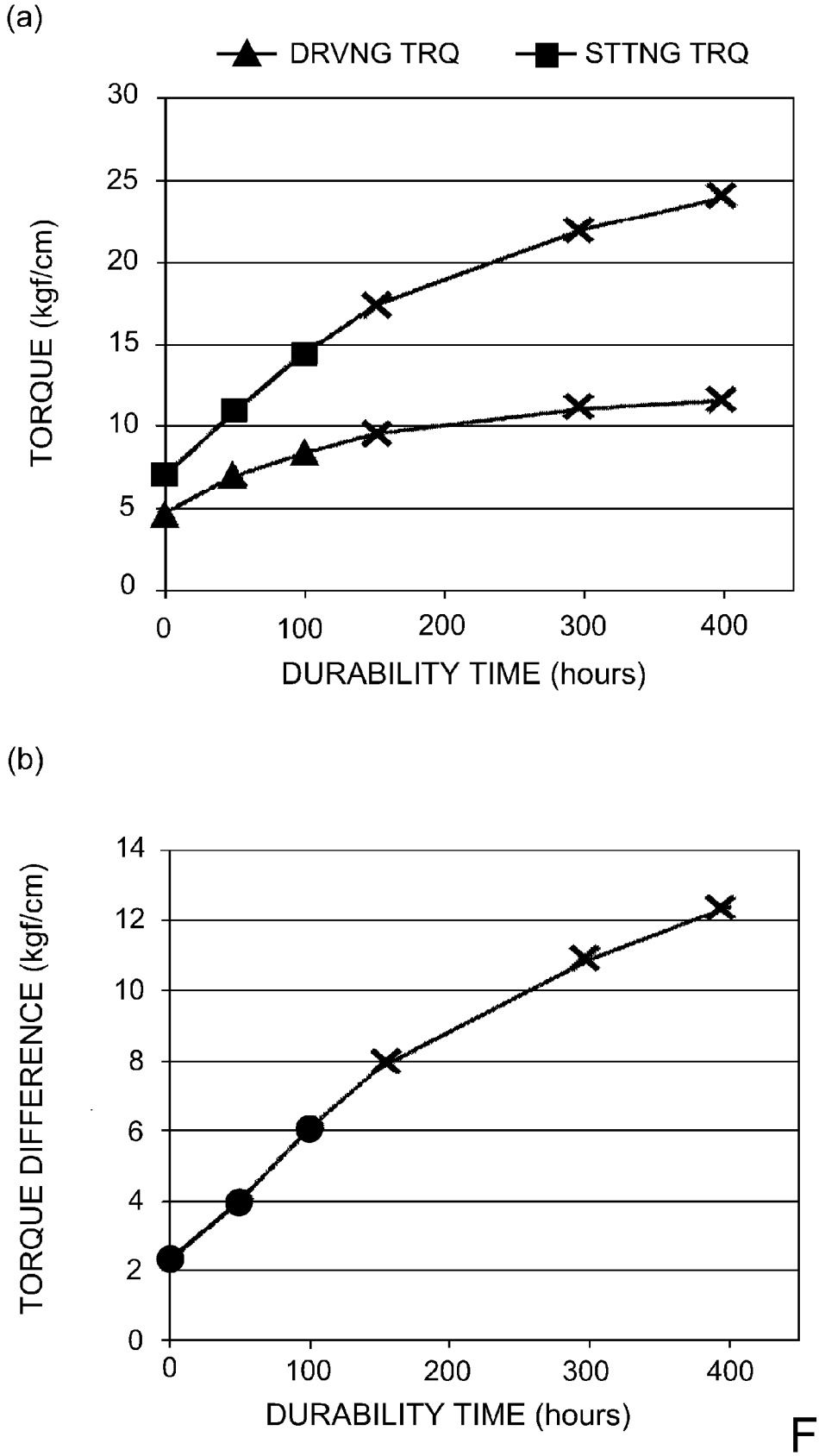

Part (a) of FIG. 7 is a graph showing a relationship between a durability time and the rotational torque in an actual machine durability test, and part (b) of FIG. 7 is a graph showing a relationship between the durability time and a difference between a starting torque and a driving torque in the actual machine durability test.

Figure 8:
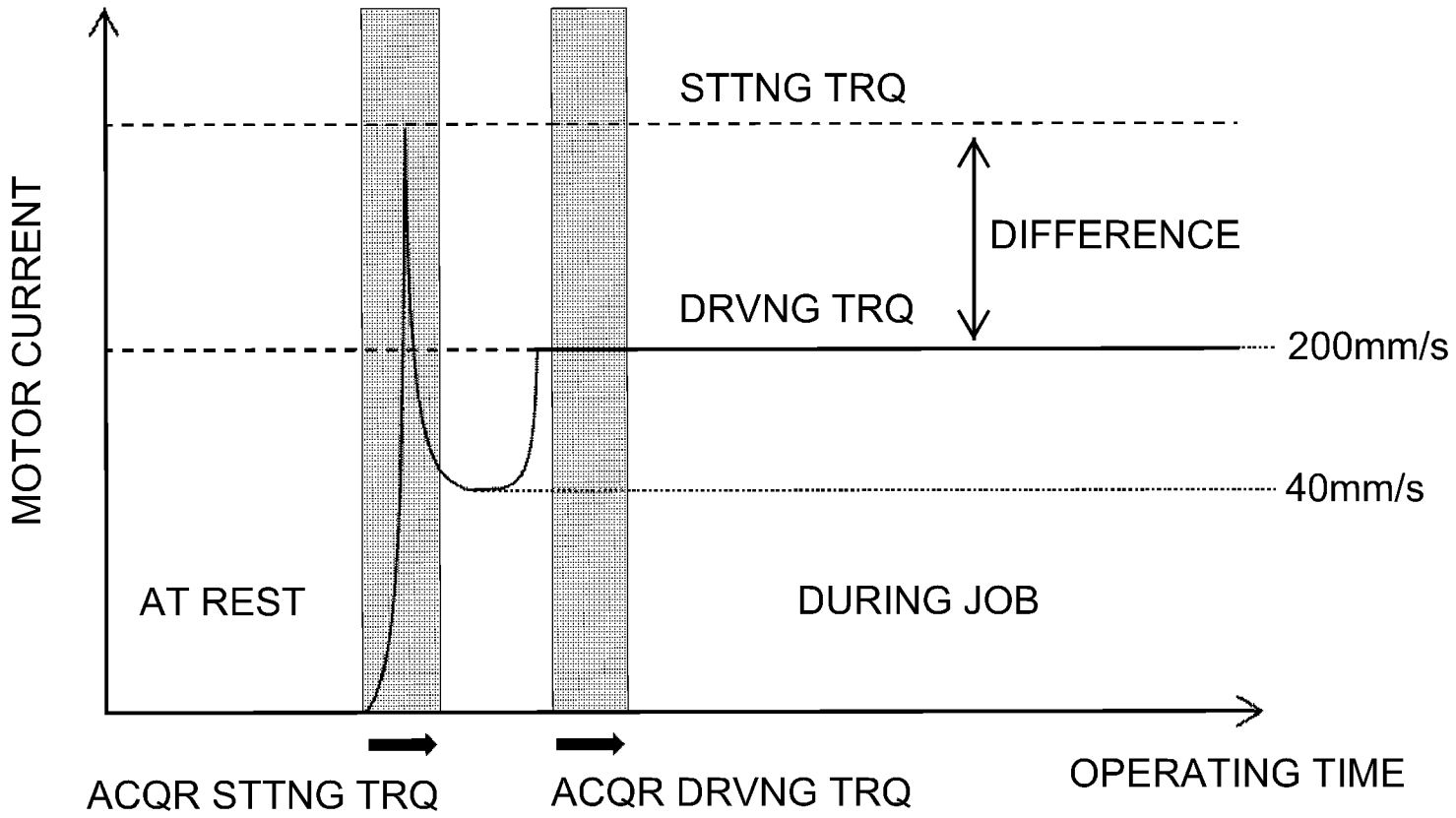

FIG. 8 shows a flow of acquiring rotational torque information.

Figure 9:
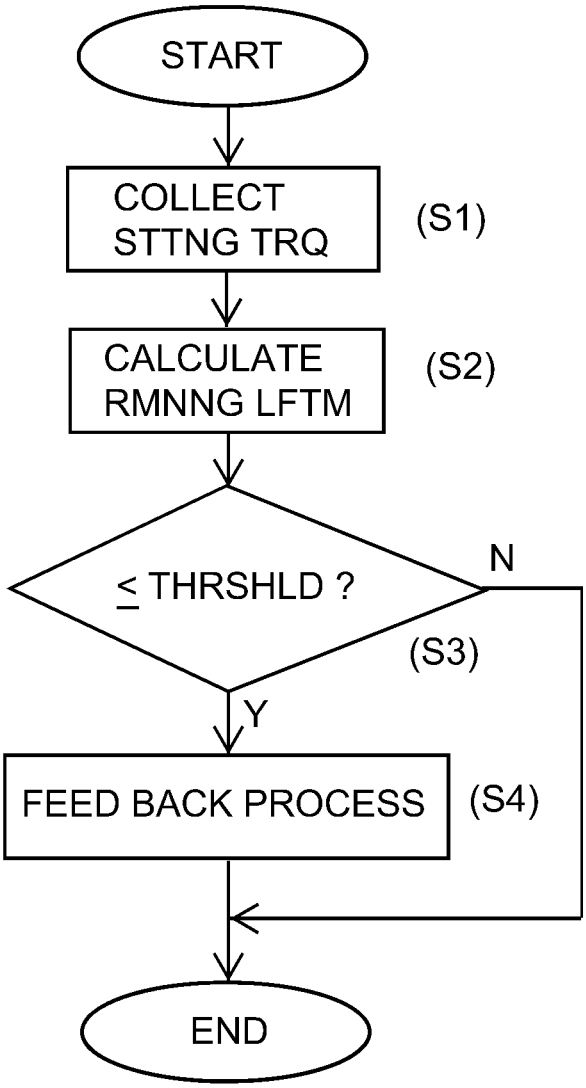

FIG. 9 is a calculation flowchart of an estimated remaining lifetime of a belt in Embodiment 1.

Figure 10:
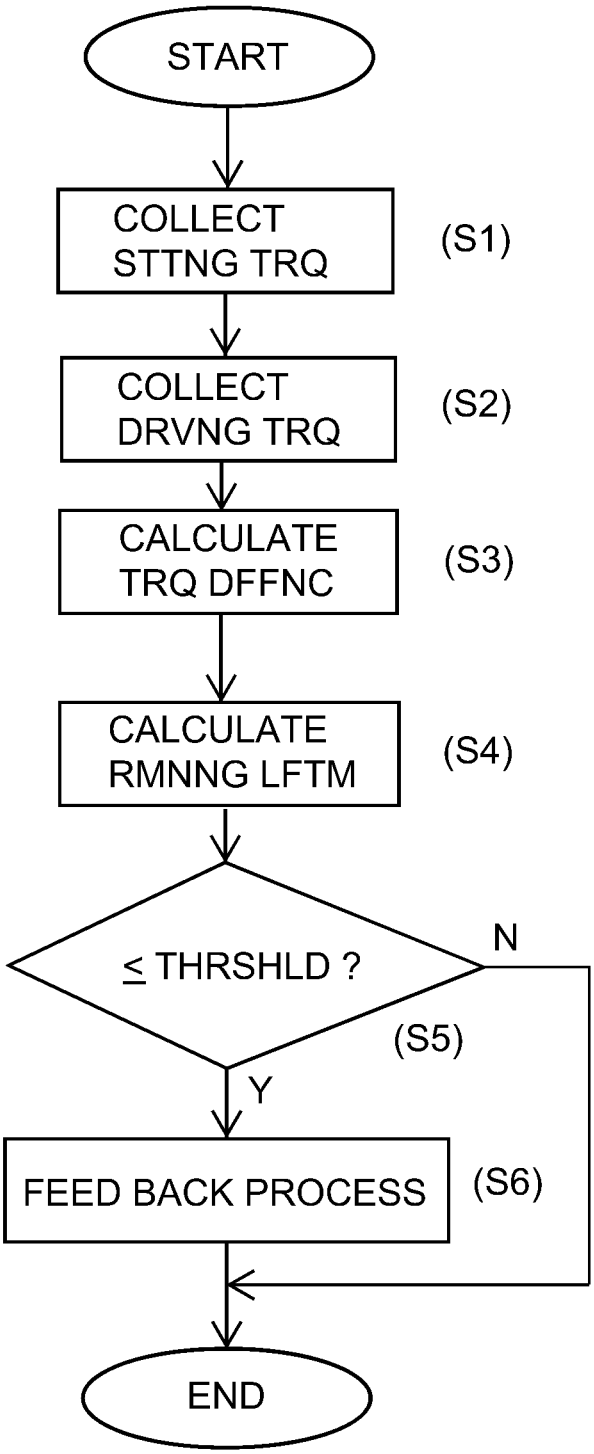

FIG. 10 is a calculation flowchart of an estimated remaining lifetime of a belt in Embodiment 2.

Figure 11:
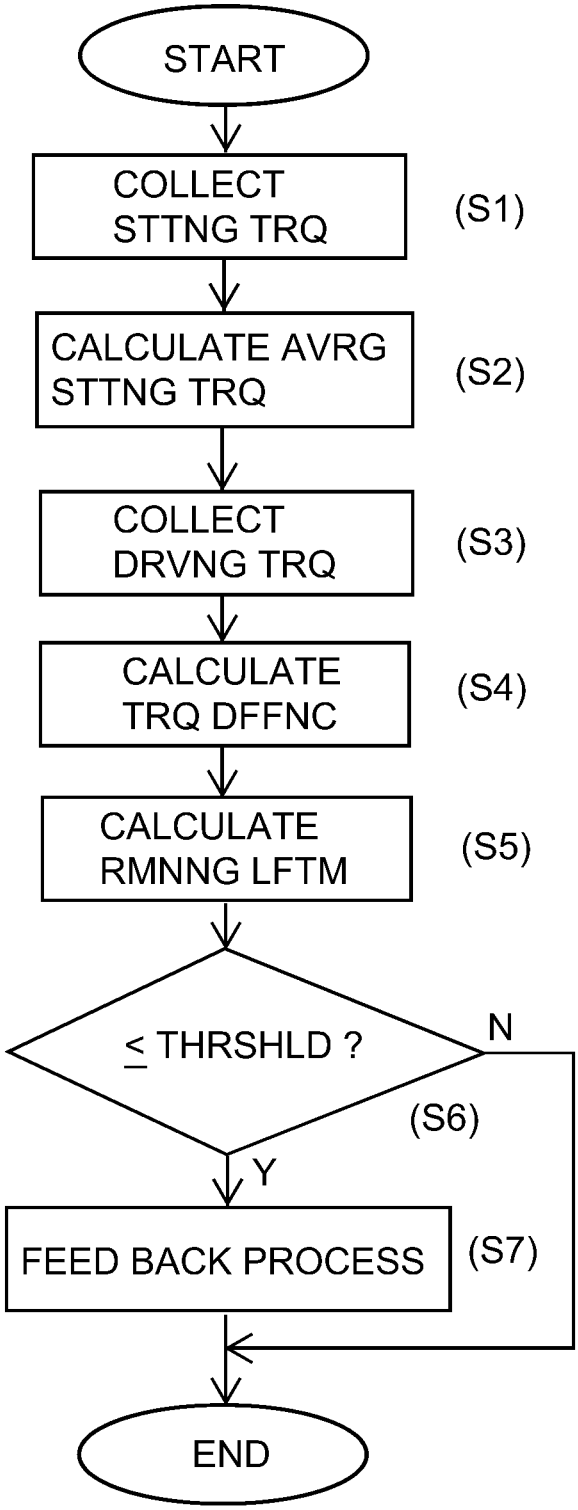

FIG. 11 is a calculation flowchart of an estimated remaining lifetime of a belt in Embodiment 3.

Figure 12:
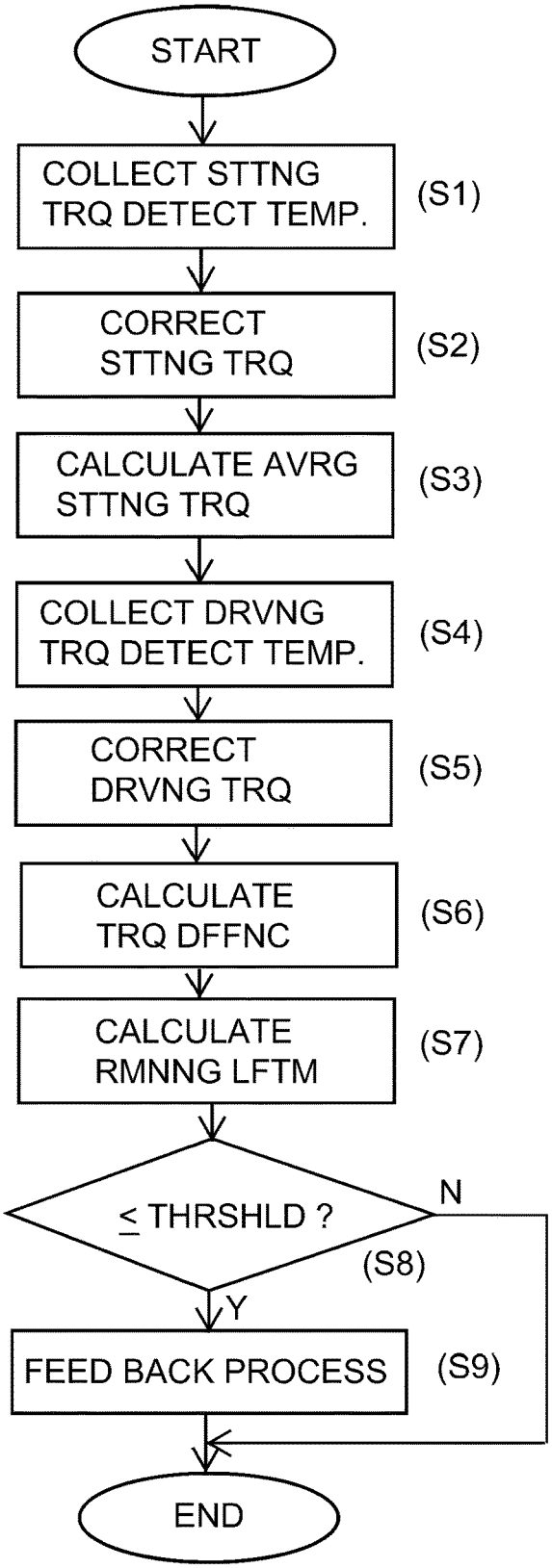

FIG. 12 is a calculation flowchart of an estimated remaining lifetime of a belt in Embodiment 4.

FIG. 13 is a temperature table of the rotational torque.

Figure 14:
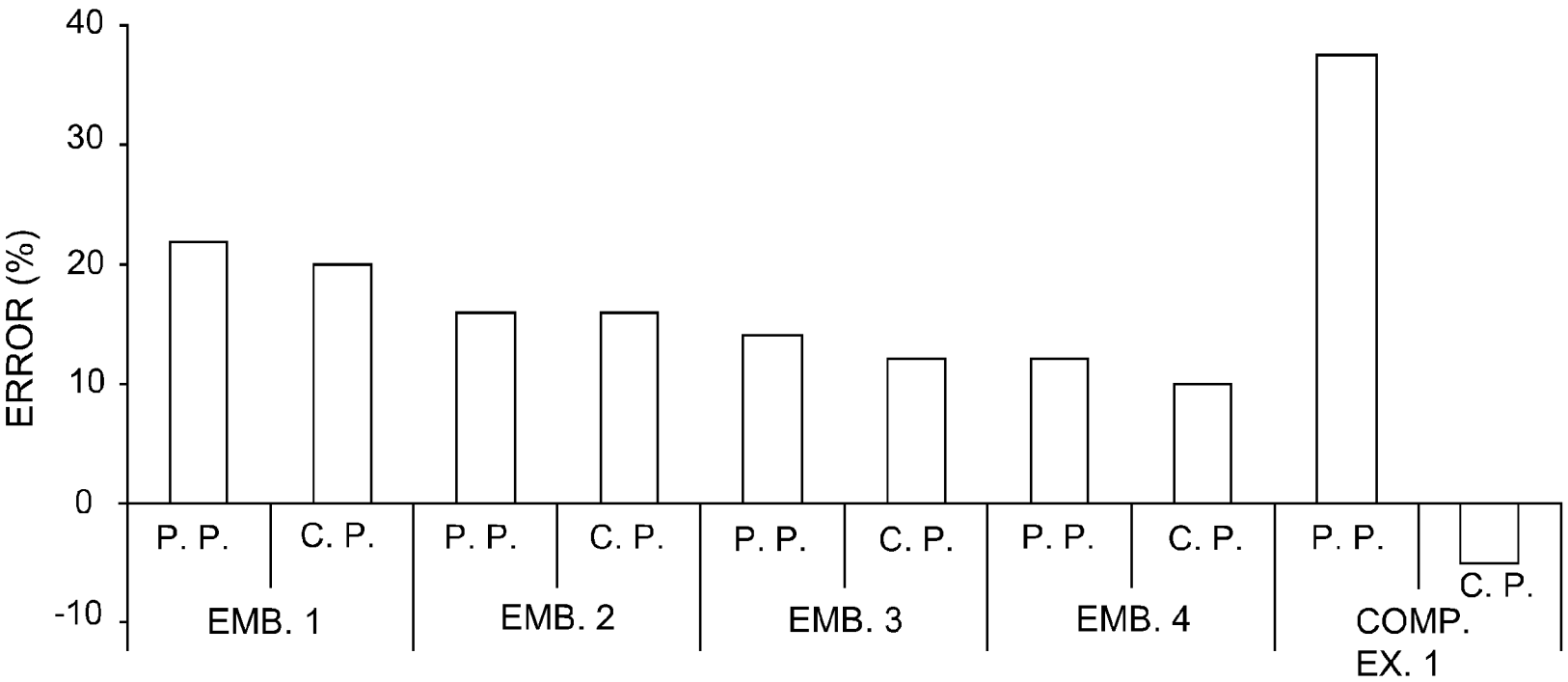

FIG. 14 is a graph showing a proportion of a sheet passing number, required until an actual lifetime reaches its end, to an estimated lifetime sheet number.

DESCRIPTION OF THE EMBODIMENTS

Embodiments of the present invention will be described. In the following embodiments, as an image forming apparatus, a laser beam printer using an electrophotographic process will be described as an example.

Embodiments

Image Forming Apparatus

Figure 3:
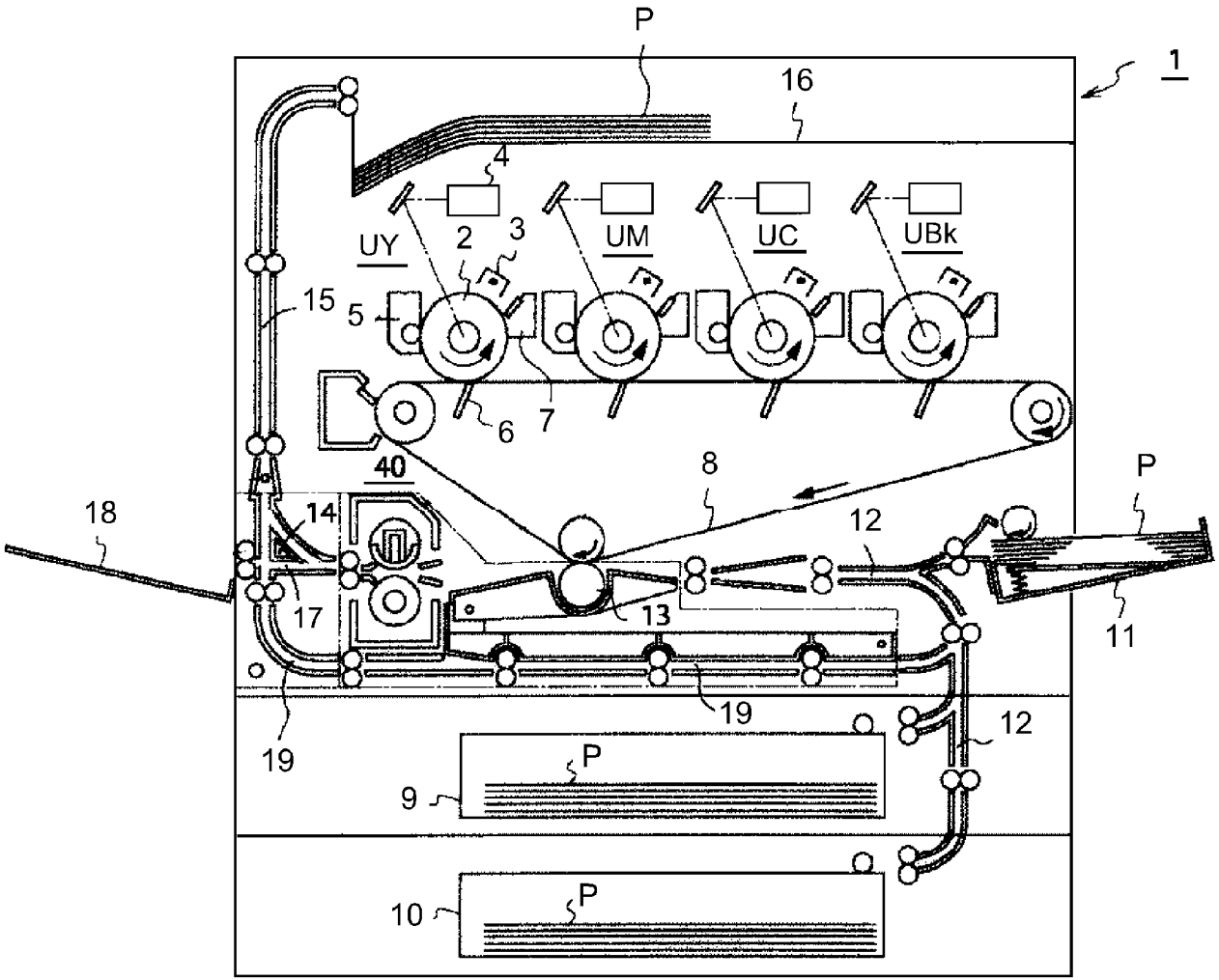
FIG. 3 is a schematic sectional view of an image forming apparatus in the embodiment.

FIG. 3 is a schematic sectional view of a printer 1 in an embodiment. The printer 1 is a full-color printer of a tandem type and an intermediary transfer type, and includes image forming portions UY, UM, UC and UK for forming respective color toner images of Y (yellow), M (magenta), C (cyan) and Bk (black).

Each of the image forming portions includes a photosensitive drum 2, a charger 3, a laser scanner 4, a developing device 5, a primary transfer charger 6 and a drum cleaner 7. In order to avoid complicatedness of the figure, indication of symbols of constituent elements of the image forming portions UM, UC and UBk other than the image forming portion UY was omitted. Further, an electrophotographic process and an image forming operation of each of the image forming portions are well known, and therefore, will be omitted from description.

The respective color toner images are primary-transferred superposedly from the drums 2 of the image forming portions onto a rotating intermediary transfer belt 8 in a predetermined manner. As a result, the superposed four color toner images are formed on the belt 8. On the other hand, a single recording material (sheet) P is fed from a cassette 9 or 10 or a manual feeding tray 11 and is passed through a feeding path 12, and is introduced into a secondary transfer nip, which is a press-contact portion between the belt 8 and a secondary transfer roller 13, at predetermined timing. As a result, the superposed four color toner images are secondary-transferred altogether from the belt onto the sheet P. The sheet P is introduced into a fixing device 40 in which the toner images are subjected to a fixing process.

The sheet P coming out of the fixing device 40 is, in the case of an operation in one-side image forming mode, directed to a feeding path 15 side by control of a flapper 14, and then is discharged onto a discharge tray 16 in a face-down start. Or, the sheet P is derived in a feeding path 17 side, and is discharged onto a discharge tray 18 in a face-up start.

In the case of an operation in a double-side image forming mode, the sheet P coming out of the fixing device 40 is once directed to the feeding path 15 side by control of the flapper 14 and then is fed back in a switch-back manner, and then is introduced in a feeding path 19 side for double-side image formation. Then, in a start in which the sheet P is turned upside down, the sheet P passes through the feeding path 12 again and is introduced into the secondary transfer nip, where the toner images are formed on the other surface of the sheet P. Thereafter, similarly as in the case of the one-side image formation, the sheet P is introduced into the fixing device 40 and then is discharged as a double-side image-formed product onto the discharge tray 16 or 18.

Fixing Device

Figure 1:
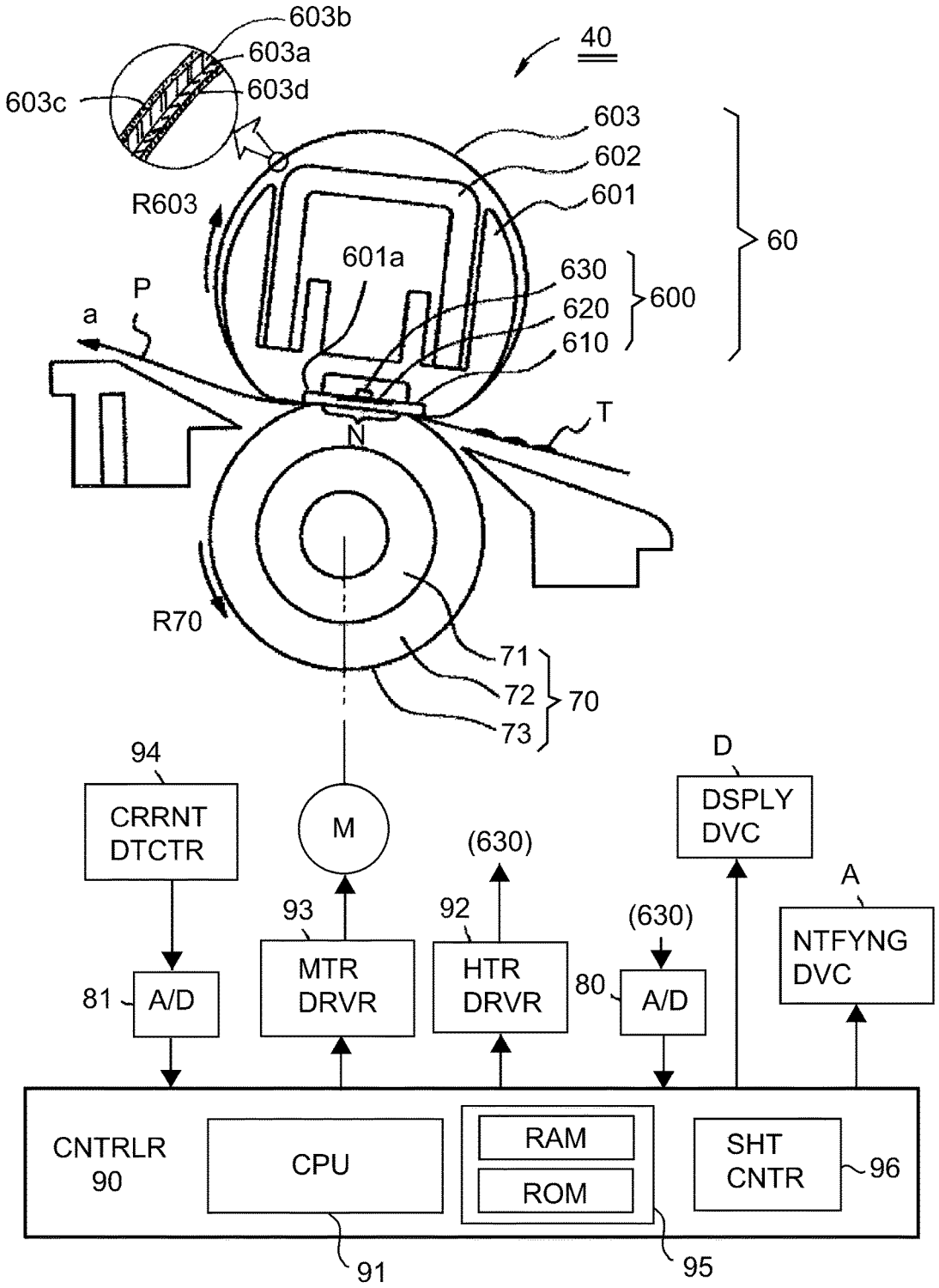
FIG. 1 is a schematic cross-sectional view of a principal part of a fixing device in an embodiment and is a block diagram of a control system of the fixing device.
Figure 2:
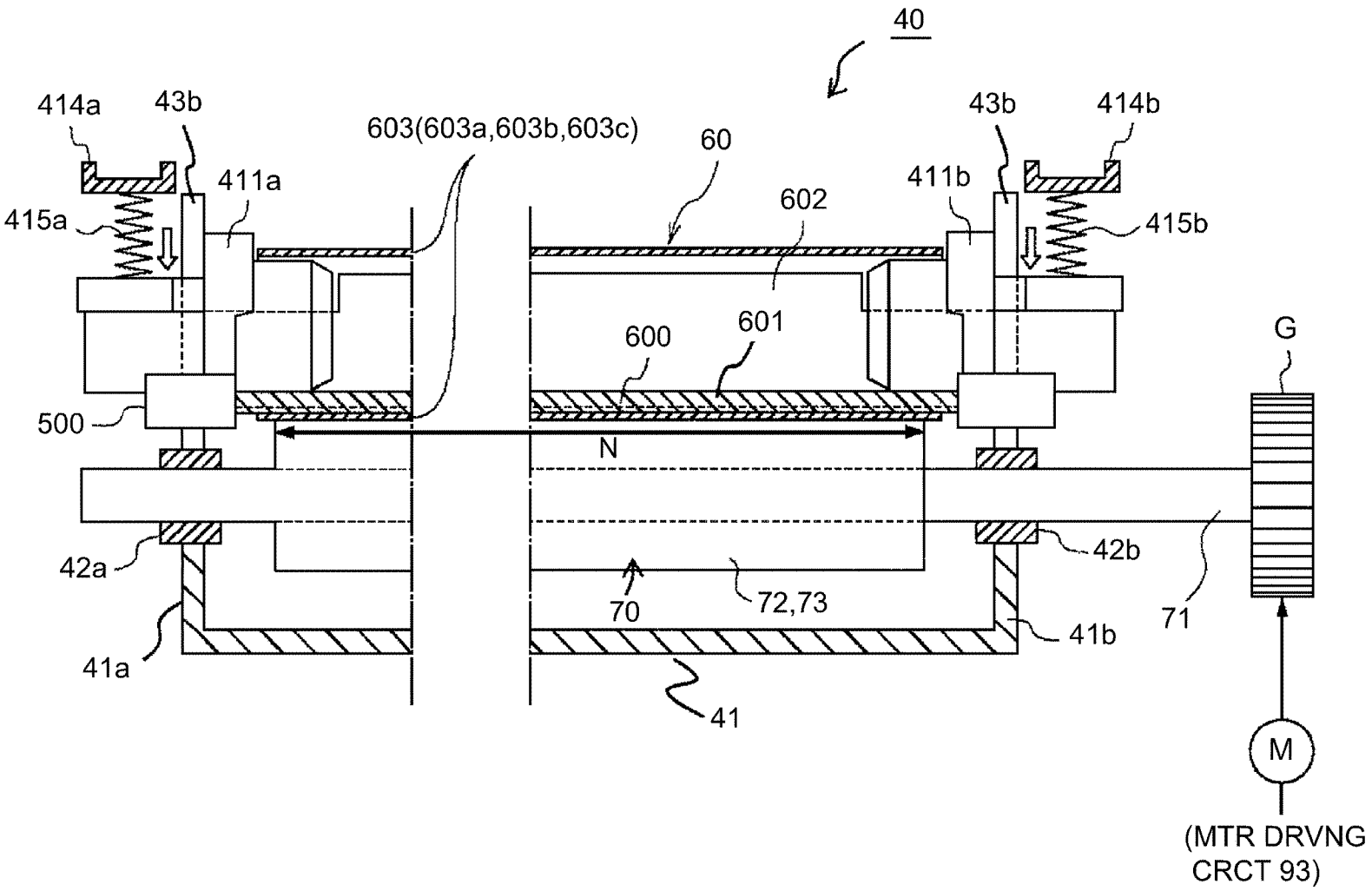
FIG. 2 is a schematic longitudinal front view of a principal part of the fixing device, in which a part of the fixing device is omitted from illustration.

The fixing device 40 in this embodiment will be described. FIG. 1 is a schematic cross-sectional view of a principal part of the fixing device 40 and a block diagram of a control system of the fixing device 40. FIG. 2 is a schematic longitudinal front view of a principal part of the fixing device 40, in which a part of the fixing device 40 is omitted from illustration. A front surface (side) of the fixing device 40 is a surface (side) as seen from a sheet introduction side.

The fixing device 40 is an image heating apparatus (device) and roughly includes a belt unit (film unit) 60, an elastic pressing roller 70 and a device casing 41 in which these members are accommodated and disposed substantially parallel to each other.

The belt unit 60 includes a heater (heating member) 600 functioning as a pad, and includes a heater holder 601 fixedly supporting the heat holder 601. The belt unit 60 further includes a supporting stay 602 supporting the heater holder 601. Further, the belt unit 60 includes an endless belt-like (cylindrical) flexible thin fixing belt (first rotatable member, hereinafter referred to as a "belt") 603 which is loosely fitted around an assembly of these members and which is used as a heat-conductive member. The belt 603 is rotatable while sliding as a slidable member with the heater 600 at an inner surface thereof.

A pressing roller (second rotatable member) 70 is contacted to the belt 603 toward the heater 600 against elasticity of the belt, and forms a fixing nip N, between itself and the belt 603, for nip-feeding and heating sheet P carrying images T.

In the fixing device 40 in this embodiment, the heater 600 presses (urges) the belt 603 toward the pressing roller 70 so that the nip N has a predetermined width with respect to a sheet feeding direction (recording material feeding direction) a. In a process in which the sheet P is nipped and fed through the nip N, heat generated by the heater 600 is imparted to the sheet P through the belt 603, so that the toner images T on the sheet P are fixed as fixed images under application of heat and pressure.

In this embodiment, the heater 600 is a so-called ceramic heater. This heater 600 includes a substrate 610 and a heat generating resistor (heat generating resistor layer, hereinafter referred to as a "heat generating member") 620, provided on the substrate 610, for generating heat. The heater 600 further includes a thermistor (TH) 630 which is a temperature sensor (thermistor detecting portion, temperature detecting means) for detecting a temperature of the heater 600. The heater 600 is engaged in a recessed portion 601*a* provided on a lower surface of the heater holder 601 so as to extend along a longitudinal direction of the heater holder 601.

In this embodiment, at a back surface side (where the substrate 610 does not contact the belt 603) of the substrate 610, a heat generating member 620 is provided. The thermistor 630 is provided at a back surface side of the heater 600. However, the present invention is not limited thereto, but the heat generating member 620 may also be provided on a front surface side (where the substrate 610 contacts the belt 603) of the substrate 610.

Onto the front surface of the substrate 610, a semisolid lubricant (hereinafter referred to as "grease") consisting of a solid component (compound) and a base oil component (oil) is applied. By this grease, a friction load between the belt 603 and the heater 600 is reduced, so that a sliding property between the heater 600 and the belt 603 and a sliding property between the heater holder 601 and the belt 603 are ensured.

As the compound of the friction, a solid lubricant such as graphite or molybdenum disulphide, a metal oxide such as zinc oxide or silica, a fluorine-containing resin material such as polytetrafluoroethylene (PTFE), or the like may be used. As the oil of the grease, a heat-resistant polymer (resin) oil such as a silicone oil or a fluorosilicone oil may be used. In this embodiment, grease in which PTFE powder fine particles (particle size: 3 μm) is used as the compound and in which the fluorosilicone oil is used as the oil is used. In this embodiment, the belt 603 is prepared by forming on a base material 603*a*, an elastic layer 603*b* and a parting layer 603*c* and by forming, at an inner surface of the base material 603*a*, an inner surface slidable layer 603*d*. Specifically, as the base material 603*a*, a cylindrical member which is 30 mm in outer diameter, 340 mm in length (width) and 30 μm in thickness and which is formed of a nickel alloy is used. Further, on the base material 603*a*, as the elastic layer 603*b*, a silicone rubber layer having a thickness of 400 μm is formed, and on the elastic layer 603*b*, as a parting layer 603*c*, a fluorine resin tube having a thickness of about 20 μm is coated. Further, as the inner surface slidable layer 603*d*, an about 10 μm-thick polyimide (PI) layer is used.

The heater holder 601 (holder 601) functions to hold the heater 600 in the state of urging the heater 600 toward the inner surface of the belt 603. The holder 601 has a substantially semi-arcuate cross-sectional shape and functions to regulate a rotation orbit of the belt 603. The holder 601 may be made of heat-resistant resin material or the like. In this embodiment, it is Zenite 7755 (trade name) available from Dupont.

The support stay 602 (stay 602) is member for supporting the heater 600 by way of the holder 601. The stay 602 is preferably made of a material which is not easily deformed even when a large load is applied thereto, and in this embodiment, it is made of SUS 304 (stainless steel).

As shown in FIG. 2, the stay 602 is supported by left and right flanges 411*a* and 411*b* at the opposite end portions with respect to the longitudinal direction. The flanges 411*a* and 411*b* may be simply called flange 411. The flange 411 regulates the movement of the belt 603 in the longitudinal direction and the circumferential direction of the belt 603. The flange 411 is made of heat resistive resin material or the like. In this embodiment, PPS (polyphenylenesulfide resin material) is used.

Flanges 411(*a, b*) are engaged with guide slits 43(*a, b*) provided on side plates 41(*a, b*) at one end side and at the other end side, respectively, of the device casing 41, and thus have a degree of freedom of sliding (moving) in directions toward and away from the pressing roller 70. Further, between the flanges 411(*a, b*) and pressing arms 414(*a, b*) urging springs 415(*a, b*) are provided in a compressed state.

With such a structure, an elastic force of each of the urging springs 415(*a, b*) is applied to the heater 600 through the flange 411, the stay 602 and the holder 601. Further, the belt 603 is urged with a predetermined urging force toward the pressing roller 70 by the heater 600 or by the heater 600 and the holder 601 against elasticity of the elastic layer 72 of the pressing roller 70. As a result, the nip N having a predetermined nip width with respect to the sheet feeding direction a is formed between the belt 603 and the pressing roller 70. In this embodiment, the pressure is about 156.8 N (16 kgf) in each of one end side and the other end side, and is about 313.6 N (32 kgf) in total.

A connector 500 is an electric energy supply member electrically connected with the heater 600 for applying a voltage to the heater 600. The connector 500 is detachably provided in one longitudinal end side of the heater 600.

In this embodiment, the pressing roller 70 is a rotatable driving member for forming the nip N, for heating the toner image T on the sheet, in cooperation with the belt 603 and for rotating the belt 603.

The pressing roller 70 has a multi-layer structure in which an elastic layer 72 is provided on a core metal 71 of a metal material and a parting layer 73 is provided on the elastic layer 72. As the core metal 71, stainless steel, SUM (sulfur and sulfur-containing free-machining steel), and aluminum can be used. As the elastic layer 72, a silicone rubber layer, a sponge rubber layer or an elastic foam rubber layer can be used. As a parting layer 73, a fluorine-containing resin material such as tetrafluoroethylene-perfluoroalkylvinyl ether copolymer (PFA) can be used.

In this embodiment, the pressing roller 70 includes the core metal 71 of stainless steel, the elastic layer 72 of silicone rubber foam, and the parting layer 73 of fluorine-containing resin tube. The pressing roller 70 is about 25 mm in outer diameter, and 330 mm in longitudinal length of the elastic layer 72.

Both end portions of the core metal 71 of the pressing roller 70 are rotatably held between the side plates 41*a* and 41*b* via bearings 42(*a, b*) in one end side and the other end side of the device casing 41. At one end portion of the core metal 71, a gear G is provided and transmits a rotational driving force of a motor (driving portion, driving means) M to the core metal 71.

Motor M is driven by a motor driving circuit 93 controlled by a controller 90 (control means). The pressing roller 70 driven by the motor M is rotationally driven in an arrow R70 direction in FIG. 1 and transmits the driving force to the belt 603 at the nip N, so that the belt 603 is rotated in an arrow R603 direction by the rotational drive of the pressing roller 70. In this embodiment, the motor driving circuit 93 is controlled by the controller 90 so that a surface speed of the pressing roller 70 is 200 mm/sec.

The controller 90 is a circuit including a CPU 91 operating with various controls, and a storing portion 95 including a non-volatile medium or a volatile medium, such as an RAM or a ROM. Programs and reference tables are stored in the ROM, and the CPU 91 reads them to effect the various controls.

Electric power is supplied to the heater 600 from a heater driving circuit 92 via a connector 500. By this electric power supply, the heat generating member 620 of the heater 600 generates heat, so that an effective heat generation width region of the heater 600 abruptly increases in toner. Then, the temperature of the heater 600 is detected by the thermistor 630, and an output depending on detected temperature information is sent to the controller 90 through an A/D converter 80.

The controller 90 reflects the temperature information acquired from the thermistor 630 in the electric power supply control of the heater driving circuit 92 and controls the electric power supplied to the heater 600. In this embodiment, a type in which the controller 90 carries out a wave number control or a phase control of the output of the heater driving circuit 92 to adjust an amount of heat generation of the heater 600 is used, so that when the toner image is fixed on the sheet, the temperature of the heater 600 is increased and maintained at a predetermined temperature (temperature control).

As described above, the pressing roller 70 is rotationally driven by the drive of the motor M. With this rotational drive, the belt 603 is rotated while sliding at its inner surface in intimate contact with the surface of the heater 600 or with the surface of the heater 600 and a part of an outer surface of the holder 601. Further, the control of the electric power supply to the heater 600 is carried out, and the temperature of the heater 600 in a heat generation region is increased to a pressing roller temperature and thus the heater is temperature-controlled.

In this device start, from the image forming portion side, the sheet P on which the unfixed toner image is carried is introduced into the fixing device 40, and enters the nip N, where the sheet P is nipped and fed. As a result, at the nip N, the toner image is fixed on the sheet P under application of heat and pressure. The sheet P passed through the nip N is curvature-separated from the surface of the belt 603 and is fed and discharged.

Stick-Slip Noise

At an inner surface of the belt 603, as described above, the inner surface slidable layer (hereinafter, referred to as a "belt inner surface layer") 603 is provided for protecting the substrate, and grease is applied onto the belt inner surface layer 603*d* in order to reduce a sliding (frictional) load. However, even in the case where the belt inner surface layer 603*d* is provided and the grease is applied onto the belt inner surface layer 603*d*, with a lapse of an operating time of the fixing device 40, the grease interposed between the belt 603 and the heater is subjected to a high temperature for a long time. For that reason, the oil component of the grease is volatilized and disappears, or viscosity of an entirety of the grease lowers due to a decrease in molecular weight of the oil component of the grease.

Further, with the volatilization and the lowering in viscosity of the oil component of the grease, when the grease flows from an inside to an outside of the nip, an oil film thickness formed by the grease becomes thin, so that a contact probability between the belt inner surface layer 603*d* and the heater 600 becomes high. As a result, abrasion (wearing) of the belt inner surface layer 603*d* is accelerated.

As a result, a sliding property between the belt inner surface layer 603*d* and the heater 600 lowers, and finally, a stick-slip phenomenon such that a stick (sticking) state and a slip (slipping) state are repeated between two surfaces of the belt inner surface layer 603*d* and the heater 600 generates. Then, this stick-slip phenomenon becomes conspicuous, so that a stick-slip noise generates. When the abrasion of the belt inner surface layer 603*d* further progresses, the belt substrate 603*a* is damaged and breakage of the belt generates in some cases.

Parts (a) and (b) of FIG. 4 show results of measurement of a change with time of a feeding direction speed of the belt 603 during steady-state drive (during normal drive) and during generation of a stick-slip noise, respectively.

During normal drive, as shown in part (a) of FIG. 4, the feeding direction speed stably changes in the neighborhood of a set process speed (50 mm/s). On the other hand, during generation of the stick-slip noise, as shown in part (b) of FIG. 4, the feeding direction speed vibrates in a range in which the feeding direction speed largely exceeds the set process speed. Here, a start in which the feeding direction speed is zero shows the stick start, and a start in which the feeding direction speed changes from zero and largely exceeds the set process speed shows the slip start.

Principle of Remaining Lifetime Estimation Means Until Generation of Stick-Slip Noise The generation of the stick-slip noise largely depends on the oil film thickness of the grease interposed between the belt inner surface layer 603*d* and the heater 600, a start of the belt inner surface layer 603*d* and a surface start of the heater 600.

In slip friction between two flat surfaces through the oil film, a coefficient μ of dynamic (kinetic) friction and a coefficient η×U/P which is a combination of a sliding speed U, a pressure P and a viscosity η can be associated with each other by a relationship of a Stribeck curve shown in FIG. 5.

As shown in FIG. 5, a friction start between the two surfaces can be divided into three regions (I), (II) and (III) depending on the viscosity of the lubricating oil. The region (III) is a hydrodynamic lubrication region in which the lubricating oil is interposed between the two surfaces and sufficiently separates and lubricates the two surfaces. The region (I) is a boundary lubrication region in which the lubricating oil film becomes remarkably thin and contact points generated between the two surfaces are in a state in which the contact points sufficiently displace molecules of the lubricating oil. The region (II) is a mixed lubrication region in which a start of the boundary lubrication region and a start of the hydrodynamic lubrication region exist in mixture.

Here, the stick-slip phenomenon has been known to generate in a start of the mixed lubrication region. Further, it is known that the stick-slip phenomenon is liable to generate with an increasing driving between a static frictional force and a dynamic frictional force, and an amplitude of a self-excited vibration becomes large and the stick-slip phenomenon causes the stick-slip noise and thus is conspicuous.

A sliding portion between the belt inner surface layer 603*d* and the heater 600 in an initial stage of an operation of the fixing device 40 is formed in a start in which the oil film is formed in a large thickness between the two surfaces and operates in the hydrodynamic lubrication region (III). With a lapse of an operating time of the fixing device 40 an amount of the oil in the grease gradually decreases, and at the same time, the viscosity of the grease lowers, so that the thickness of the oil film formed between the belt inner surface layer 603*d* and the heater 600 becomes thin.

When the fixing device 50 operates for a long time, the thickness of the oil film formed between the two surfaces becomes very thin, so that the lubrication start changes from the start of the hydrodynamic lubrication region (III) to the start of the mixed lubrication region (II) and then to the start of the boundary lubrication region (I). As a result, the contact probability between the belt inner surface layer 603*d* and the heater 600 becomes high, so that abraded powder (PI abraded powder) of the belt inner surface layer 603*d* starts to enter the sliding portion and thus starts to deposit on the surfaces of the belt inner surface layer 603*d* and the heater 600.

FIG. 6 is a graph showing a relationship between an inclusion amount (ratio) of the PI abraded powder in the grease and each of a starting torque and a driving torque of the motor M which is a driving portion (driving means) for the pressing roller 70. The starting torque is a rotational torque of the motor M when the motor M is actuated from a rest start. The driving torque is a steady-state torque when the motor M is in a start in which rotation of the motor M is stable after the motor M is actuated.

In this embodiment, rotational torque information of the motor M is acquired in the following manner. That is, a motor current detecting portion (current value detecting means) 94 for detecting a value of a current flowing through the motor M driven by the motor driving circuit 93 is provided. An output depending on the current value detected by the motor current detecting portion 94 is inputted to the controller 90 through the A/D converter 81. The controller 90 calculates and acquires the rotational torque information (torque value) of the motor M (driving portion, driving means) from motor current value information inputted from the motor current detecting portion 94.

The driving torque reflects the frictional force formed in a start in which the oil film of the grease is formed at least locally on the sliding surface, and therefore, the PI abraded powder is mixed in the grease and acts as fluid, so that an influence by the inclusion of the PI abraded powder becomes relatively small. Accordingly, as shown in FIG. 6, even when the inclusion amount (mixing ratio) of the PI abraded amount increases, although the driving torque is increased by the change of the viscosity of the grease, a rate of the increase is relatively small.

On the other hand, the starting torque reflects the frictional force formed in a start in which the oil film of the grease is not formed on the sliding surface, and therefore, the starting torque is considerably influenced by the deposition of the PI abraded powder on the surfaces of the belt inner surface layer 603*d* and the heater 600. As a result, as shown in FIG. 6, a rate of an increase of the starting torque is relatively large by the increase of the inclusion amount of the PI abraded powder.

Part (a) of FIG. 7 is a graph showing an example of a relationship between a generation start of the stick-slip noise and each of the starting torque and the driving torque at a process speed of 80 mm/s in an actual durability test. In part (a) of FIG. 7, plots show changes of the starting torque and the driving torque with a durability time, and a condition (durability time, torque value) in which the stick-slip noise generated is represented by "x". From (a) of FIG. 6, at an initial stage of the durability test, the stick-slip noise does not generate, and with a lapse of the durability time, the starting torque and the driving torque increase. Further, the rate of the increase of the starting torque is higher than the rate of the increase of the driving torque.

Accordingly, although both of values of the starting torque and the driving torque are increased by the increase of the inclusion amount of the PI abraded powder with the lapse of the operating time of the fixing device 40, the rates of the increase are different between the starting torque and the driving torque due to the above-described reason. Therefore, as shown in part (b) of FIG. 7, with the lapse of the operating tie of the fixing device 40, a difference between the starting torque and the driving torque (difference between the static frictional force and the dynamic frictional force) increases, so that the stick-slip phenomenon becomes conspicuous and the stick-slip noise starts to generate.

From the above, as an estimating means of a lifetime by the stick-slip noise, discrimination using the starting torque is more effective than discrimination using the driving torque since a surface start of the sliding surface is easily reflected. Further, by a difference between the starting torque and the driving torque, a degree of an amplitude of the stick-slip can be discriminated, and therefore, a sign can be detected before the stick-slip noise generates.

Accordingly, the starting torque with which the stick-slip noise generates or the difference between the starting torque and the driving torque is checked in advance at a stage of production design and a threshold is set in advance. Then, redundancy, of the belt (fixing slidable member) on the basis of the threshold, with respect to the stick-slip noise can be estimated with accuracy.

Remaining Lifetime Estimation Sequence Until Generation of Stick-Slip Noise

FIGS. 9 to 12 are flowcharts of a remaining lifetime estimation sequence for calculating an estimated remaining lifetime of the belt (i.e., calculation flowcharts of the estimated lifetime of the belt) in Embodiments 1 to 4, respectively. FIG. 8 shows a flow of acquiring rotational torque information.

With reference to FIG. 8, first, the controller 90 carries out control of collecting the starting torque information when the motor M which is the driving portion for driving the pressing roller 70 is actuated from a rest start. As regards selection of a process speed at which the starting torque information is acquired, the process speed may desirably be lower than a process speed set in advance for each of kinds of sheets (papers) during image formation. This is because measurement accuracy is enhanced for acquiring the starting torque information as an instantaneous value.

Next, the controller 90 carries out control of collecting the driving torque information of the motor M when pressing roller 70 is idled in a steady start. As regards selection of a process speed at which the driving torque information is acquired, the process speed may desirably be synchronized with a process speed set in advance for each of kinds of sheets (papers) during image formation. This is because accuracy of lifetime estimation is enhanced by estimating a lifetime, due to generation of the stick-slip noise, at the process speed actually used.

Specifically, in Embodiment 1 (FIG. 9), when the remaining lifetime estimation sequence of the belt 603 is carried out, the motor driving circuit 93 is drive-controlled by the controller 90 that the pressing roller 70 is idled from a rest start at 40 mm/s. At this time, the controller 90 calculates the rotational torque information from motor current value information acquired from the motor current detecting portion 94 and collects (acquires) a maximum (instantaneous value) of the rotational torque information as starting torque information (S1).

Then, the controller 90 discriminates an estimated remaining lifetime of the belt 603 (start of the belt 603) on the basis of the acquired starting torque information, and carries out a corresponding operation (feed-back process) on the basis of the discrimination (S2 to S4).

In Embodiment 1 (FIG. 10), after the starting torque information is acquired, the motor driving circuit 93 is drive-controlled by the controller 90 so that the pressing roller 70 is idled for 3 seconds at 200 mm/s. Then, the controller 90 collects driving torque information (steady-state torque information during steady-state rotation of the motor M) during the period (3 sec) (S2). That is, during the period, the controller 90 calculates the rotational torque information from motor current value information acquired from the motor current detecting portion 94 and collects the rotational torque information as driving torque information.

Then, the controller 90 discriminates an estimated remaining lifetime of the belt 603 (start of the belt 603) on the basis of a difference between the starting torque information and the acquired driving torque information, and carries out a corresponding operation (feed-back process) on the basis of the discrimination (S3 to S6).

Here, 200 mm/s is the process speed when the image is formed on plain paper but may also be changed to other process speeds, such as 120 mm/s and 80 mm/s when the image is formed on thick paper having a different basis weight. In this case, a threshold used for discriminating the lifetime due to generation of the stick-slip noise is different among respective speeds, and therefore, is separately set for each of the speeds.

The starting torque and the driving torque are calculated by the controller 90 by sampling a motor current value sent from the motor current detecting portion 94 through the A/D converter 81. As regards the starting torque, a maximum torque value when the start of the motor M is switched from the rest start to a driven start is discriminated as the starting torque. As regards the driving torque, an average of torque values during rotation for 3 seconds is discriminated as the driving torque at the process speed.

In Embodiment 2, after the starting torque is acquired, the pressing roller 70 is rotated and the driving torque is acquired, but this order may also be reversed. In this case, the motor M is drive-controlled so that the pressing roller 70 is idled for 3 seconds at 200 mm/s, and then the acquired maximum (instantaneous value) of the rotation torque is collected as the starting torque information.

In Embodiments 1 and 2, as regards the starting torque, starting torque values for a plurality of times of repetition of the rest start and the driven start of the motor M are acquired by performing an operation of repeating the rest start and the driven start the plurality of times, and an average thereof or a statistic thereof such as a median value may also be used as the starting torque value. As a result, the number of times of acquisition of the starting torque can be increased, and a measurement error can be suppressed, and therefore, estimation accuracy of the estimated remaining lifetime can be enhanced.

The acquisition of the starting torque information may also be carried out in the following manner. That is, as shown in Embodiment 3 (FIG. 11), by using newly acquired torque information and torque information values of a plurality of times which are acquired among preceding jobs and which are stored in a storing portion 95, an average thereof or a statistic thereof such as a median value may also be used as the starting torque information used for estimating the remaining lifetime (S1, S2). As a result, measurement accuracy can be enhanced while shortening an acquiring time of the starting torques among the jobs.

In Embodiment 3, the estimated remaining lifetime of the belt 603 (start of the belt 603) is discriminated on the basis of a difference between the starting torque information acquired as described above and the driving torque information (S3) acquired similarly as in Embodiment 2 (S4 to S6). Then, a corresponding operation (feed-back process) on the basis of the discrimination is carried out (S7).

In Embodiments 1 to 3, the starting torque information used for discriminating the start of the belt 603 can be changed to corrected starting torque information which is subjected to correction conversion with temperature information.

That is, a temperature detecting means for acquiring temperature information of a device constituent portion of the fixing device 40 is provided. Further, temperature table of the rotational torque of the motor M is stored in the storing portion 95 in advance. Examples of the device constituent portion may include the belt 603, the pressing roller 70, the heater 600 and the nip N. In this embodiment, the thermistor 630 for acquiring the temperature information of the heater 600 is used as the temperature detecting means.

As regards the rotational torque information of the motor M, the controller 90 acquires the starting torque information when the motor M is actuated from the rest start and acquires the temperature information from the thermistor 630. Then, the acquired starting torque information is converted to corrected starting torque information at an arbitrary temperature by the acquired temperature information and the temperature table. This corrected starting torque information can be used as the starting torque information used for discriminating the start of the belt 603 in Embodiments 1 to 3.

In Embodiments 1 to 3, the driving torque information (steady-state torque information) used for discriminating the start of the belt 603 can be changed to corrected driving torque information (corrected steady-state torque information) which is subjected to correction conversion with temperature information.

That is, similarly as in the case of the corrected starting torque information described above, the controller 90 acquires the driving torque information (steady-state torque information) during steady-state rotation of the motor M and acquires the temperature information from the thermistor 630. Then, the acquired driving torque information is converted to corrected driving torque information (corrected steady-state torque information) at an arbitrary temperature by the acquired temperature information and the temperature table. This corrected driving torque information can be used as the starting torque information used for discriminating the start of the belt 603 in Embodiments 1 to 3.

In Embodiment 4, (FIG. 12), the starting torque information and the driving torque information which are used for discriminating the start of the belt 603 in Embodiment 3 (FIG. 11) are converted to the corrected starting torque information and the corrected driving torque information which are acquired in the above-described manner.

From the thus collected pieces of the torque information, the estimated remaining lifetime of the belt 603 is calculated. Execution timing of the remaining lifetime estimation sequence of the belt 603 may also be the same timing as the image formation starting operation as in Embodiments 1 to 4 and may also be different from the timing of the image formation starting operation.

As the timing different from the timing of the image formation starting operation, an interval between consecutive image forming operations, during toner density adjustment, and the like exist. The toner density adjustment is carried out in the following manner. A patch image having a predetermined size is formed on the drum 2 in order to adjust a content of the toner transferred onto the sheet to a desired density (content). Then, the density of this patch image is read by a density sensor, and on the basis of a measurement result thereof, an output of laser light or a developing condition is changed, so that the density is adjusted. Further, in the case where the process speed is changed with a change of sheet (paper) kind setting, the remaining lifetime estimation sequence may also be carried out before and after the process speed change.

The starting torque information acquiring timing may also be in a period in which the job is started from the rest start before the start of the job and the motor start changes to the driven start as in Embodiments 1 to 4 and may also be during an operation in which the driven belt 603 is temporarily stopped and is driven again. The driving torque information acquiring timing may also be during pre-rotation before sheet passing as in Embodiments 1 to 4, during the sheet passing, and during post-rotation after the sheet passing.

The temperature of the sliding portion between the belt 603 and the heater 600 during the acquisition of the starting torque information and the driving torque information (during the acquisition of the rotational torque information) is not particularly restricted. However, the sliding portion temperature may desirably be acquired at the time when the belt 603 is heated while being idled and the temperature reaches a fixing temperature (recording material heating temperature). Or, as in Embodiment 4, the temperature information of the sliding portion between the belt 603 and the heater 600 is acquired simultaneously with the torque information, and each of the values of the torque information is corrected using a torque correction coefficient ("T.C.C.") in accordance with a temperature table, of the rotational torque, prepared separately as shown in FIG. 13, and then the estimated remaining lifetime of the belt 603 may also be calculated. The temperature table is stored in the storing portion 95.

After the remaining lifetime estimation sequence of the belt 603, the controller 90 sends a signal on the basis of a calculation result of the estimated remaining lifetime. The signal is received by a receiving portion of another circuit in the controller, and on the basis of a result thereof, a feed-back process is carried out. That is, the controller 90 performs a corresponding operation on the basis of the discrimination of the start of the belt 603.

For example, as an example of the feed-back process, display of a message of the estimated remaining lifetime at a separately provided display device (notifying portion) D and a warning operation of generating a warning sound prompting an operator to exchange the belt 603 by a separately provided notifying device (notifying portion) A can be used.

The stick-slip noise is liable to generate at high temperature and during low-speed operation. For that reason, image formation for imparting gloss (glossiness) which is not generated unless the image is fixed at high temperature and a prohibiting operation such that image formation on thick paper required that the image is formed at a low speed can also be cited as an example of the feed-back process.

Further, a start restoring operation for circulating and supplying, to the inside of the nip N, the lubricant deposited on the inner surface of the belt at an outer portion of the nip N, such as a normal rotation operation and a reverse rotation operation of the fixing device 40, and a mounting and demounting operation, and the like operation can also be cited as an example of the feed-back process.

Verification of Embodiment 1

The fixing device 40 was mounted in an electrophotographic image forming apparatus (trade name: "image RUNNER-ADVANCE C5051, manufactured by CANON KABUSHIKI KAISHA) remodeled so that the remaining lifetime estimation sequence of the belt can be carried out. Then, a sheet passing durability test was conducted under two conditions of A4-sized plain paper (basis weight: 68 g/m$^2$) and A4-sized coated paper (basis weight: 105 g/m$^2$).

At that time, the starting torque information is acquired during a start of each of jobs, and the remaining lifetime estimation sequence of the belt 603 is carried out. A flowchart of the remaining lifetime estimation sequence is shown in FIG. 9.

Specifically, when the controller 90 detects the start of the job, the pressing roller 70 is rotated from the rest start at 40 mm/s and a maximum motor current value (starting torque information) of the motor M during the period is collected by the controller 90 (S1). The temperature of the belt 603 during the collection of the motor current value is 25-180° C. Further, the number of sheets subjected to sheet passing is counted by a sheet passing number counter 96 of the controller 90 and a count value is stored in the storing portion 95. Thereafter, the estimated remaining lifetime of the belt 603 is calculated from the collected starting torque information (S2). The controller 90 discriminates whether or not a calculation result exceeds a predetermined feed-back process execution threshold (S3).

In this embodiment, remaining lifetime display is used as the feed-back process (S4), and when the estimated remaining lifetime is not more than 50,000 sheets in S3, the feed-back process (remaining lifetime display) is carried out. The estimated remaining lifetime calculated in S2 is displayed at the display device D provided on the image forming apparatus.

From the time when the estimated remaining lifetime is displayed as being not more than 50,000 sheets at the display device D, the controller 90 measures the sheet passing number until the belt 603 actually reaches an end of the lifetime thereof, and checks estimation accuracy of the remaining lifetime during the sheet passing durability test. Further, an application amount of the grease on the inner surface of the belt 603 is 1000 mg, and the belt surface temperature during the sheet passing is 180° C.

Verification of Embodiment 2

In the sheet passing durability test in the verification of Embodiment 1, the starting torque information and the driving torque information are acquired during a start of each of jobs, and the remaining lifetime estimation sequence of the belt 603 is carried out. A flowchart of the remaining lifetime estimation sequence is shown in FIG. 10.

Specifically, when the controller 90 detects the start of the job, the pressing roller 70 is rotated for 2 seconds from the rest start at 40 mm/s and a maximum motor current value (starting torque information) of the motor M during the period is collected by the controller 90 (S1).

Thereafter, the pressing roller 70 is rotated at 200 mm/s, and a motor current value is collected by the controller 90 for 3 seconds after a lapse of 2 seconds from the change of the speed so that the motor current value of the motor M is stable. The controller 90 acquires an average (driving torque information) of values of the motor current collected for 3 seconds (S2). The temperature of the belt 603 during the collection of the motor current value is 25-180° C.

Further, the number of sheets subjected to sheet passing is counted by a sheet passing number counter 96 of the controller 90 and a count value is stored in the storing portion 95. Thereafter, a difference between the collected starting torque information and the collected driving torque information is calculated by the controller 90 (S3). The estimated remaining lifetime of the belt 603 is calculated from a calculation result in S3 (S4). The controller 90 discriminates whether or not a calculation result exceeds a predetermined feed-back process execution threshold (S5).

In this embodiment (Embodiment 2), remaining lifetime display is used as the contents of the feed-back process (S6), and when the estimated remaining lifetime is not more than 50,000 sheets, the feed-back process (remaining lifetime display) is carried out. The estimated remaining lifetime of the belt 603 calculated from the calculation result in S4 is displayed at the display device D provided on the image forming apparatus.

From the time when the estimated remaining lifetime is displayed as being not more than 50,000 sheets at the display device D, the controller 90 measures the sheet passing number until the belt 603 actually reaches an end of the lifetime thereof, and checks estimation accuracy of the remaining lifetime during the sheet passing durability test. Further, an application amount of the grease on the inner surface of the belt 603 is 1000 mg, and the belt surface temperature during the sheet passing is 180° C.

Verification of Embodiment 3

In the sheet passing durability test in the verification of Embodiment 1, the starting torque information and the driving torque information are acquired during a start of each of jobs, and the remaining lifetime estimation sequence of the belt 603 is carried out. A flowchart of the remaining lifetime estimation sequence is shown in FIG. 11.

Specifically, when the controller 90 detects the start of the job, the pressing roller 70 is rotated for 2 seconds from the rest start at 40 mm/s and a maximum motor current value (starting torque information) of the motor M during the period is collected by the controller 90 (S1).

Thereafter, an average of maximum motor current values acquired before first to fourth jobs is calculated by the controller 90.

Thereafter, the pressing roller 70 is rotated at 200 mm/s, and a motor current value is collected by the controller 90 for 3 seconds after a lapse of 2 seconds from the change of the speed so that the motor current value of the motor M is stable. The controller 90 acquires an average (driving torque information) of values of the motor current collected for 3 seconds (S3). The temperature of the belt 603 during the collection of the motor current value is 25-180° C.

Further, the number of sheets subjected to sheet passing is counted by a sheet passing number counter 96 of the controller 90 and a count value is stored in the storing portion 95. Thereafter, a difference between the collected starting torque information and the collected driving torque information is calculated by the controller 90 (S4). The estimated remaining lifetime of the belt 603 is calculated from a calculation result in S4 (S5). The controller 90 discriminates whether or not a calculation result exceeds a predetermined feed-back process execution threshold (S6).

In this embodiment (Embodiment 3), remaining lifetime display is used as the contents of the feed-back process (S6), and when the estimated remaining lifetime is not more than 50,000 sheets, the feed-back process (remaining lifetime display) is carried out. The estimated remaining lifetime of the belt 603 calculated from the calculation result in S5 is displayed at the display device D provided on the image forming apparatus.

From the time when the estimated remaining lifetime is displayed as being not more than 50,000 sheets at the display device D, the controller 90 measures the sheet passing number until the belt 603 actually reaches an end of the lifetime thereof, and checks estimation accuracy of the remaining lifetime during the sheet passing durability test. Further, an application amount of the grease on the inner surface of the belt 603 is 1000 mg, and the belt (film) surface temperature during the sheet passing is 180° C.

Verification of Embodiment 4

In the sheet passing durability test in the verification of Embodiment 1, the starting torque information and the driving torque information are acquired during a start of each of jobs, and the remaining lifetime estimation sequence of the belt 603 is carried out. A flowchart of the remaining lifetime estimation sequence is shown in FIG. 12.

Specifically, when the controller 90 detects the start of the job, the pressing roller 70 is rotated for 2 seconds from the rest start at 40 mm/s, a maximum motor current value (starting torque information) of the motor M during the period is collected by the controller 90 and the temperature of the heater 600 is detected by the thermistor 630 (S1).

On the basis of the detected temperature of the heater 600, the controller 90 corrects the acquired starting torque information in accordance with the separately prepared temperature table (FIG. 13) (S2). Thereafter, an average of values obtained by correcting the maximum motor current values acquired before first to fourth jobs in a similar manner is calculated by the controller 90 (S3).

Thereafter, the pressing roller 70 is rotated at 200 mm/s, and a motor current value is collected by the controller 90 for 3 seconds after a lapse of 2 seconds from the change of the speed so that the motor current value of the motor M is stable. The controller 90 acquires an average (driving torque information) of values of the motor current collected for 3 seconds. The temperature of the heater 600 is detected by the thermistor 630 (S4). On the basis of the detected temperature of the heater 600, the controller 90 corrects the acquired starting torque information in accordance with the separately prepared temperature table (FIG. 13) (S5). The temperature of the belt 603 during the collection of the motor current value is 25-180° C.

Further, the number of sheets subjected to sheet passing is counted by a sheet passing number counter 96 of the controller 90 and a count value is stored in the storing portion 95. Thereafter, a difference between the collected average starting torque information and the collected average driving torque information is calculated by the controller 90 (S6). The estimated remaining lifetime of the belt 603 is calculated from a calculation result in S3 (S7). The controller 90 discriminates whether or not a calculation result exceeds a predetermined feed-back process execution threshold (S8).

In this embodiment (Embodiment 4), remaining lifetime display is used as the contents of the feed-back process (S6), and when the estimated remaining lifetime is not more than 50,000 sheets, the feed-back process (remaining lifetime display) is carried out. The estimated remaining lifetime of the belt 603 calculated from the calculation result in S7 is displayed at the display device D provided on the image forming apparatus.

From the time when the estimated remaining lifetime is displayed as being not more than 50,000 sheets at the display device D, the controller 90 measures the sheet passing number until the belt 603 actually reaches an end of the lifetime thereof, and checks estimation accuracy of the remaining lifetime during the sheet passing durability test. Further, an application amount of the grease on the inner surface of the belt 603 is 1000 mg, and the belt (film) surface temperature during the sheet passing is 180° C.

Comparison Example 1

As a comparison with Embodiments 1 to 5, a sheet passing durability test is conducted by an image forming apparatus in which the remaining lifetime estimation sequence of the belt 603 is not performed. Specifically, the sheet passing durability test is conducted by an electrophotographic image forming apparatus (trade name: "image RUNNER-ADVANCE C5051", manufactured by CANON KABUSHIKI KAISHA) in which the remaining lifetime is estimated by a value of a sheet passing number counter with respect to a normal lifetime sheet number (400,000 sheets).

In the sheet passing durability test, two kinds of sheets consisting of A4-sized plain paper (basis weight: 68 g/m2) and A4-sized coated paper (basis weight: 105 g/m2) are used. An application amount of the grease on the inner surface of the belt 603 is 1000 mg, and the belt surface temperature during the sheet passing is 180° C.

Result of Lifetime Estimation Accuracy in Sheet Passing Durability Test

As a result of the sheet passing durability test, in either of the sheet passing durability tests in Embodiments 1 to 4 and Comparison Example 1, the belt 603 reached an end of the lifetime thereof due to generation of the stick-slip noise. A proportion of the sheet passing number, required until the belt 603 reaches the end of the actual lifetime, relative to the estimated lifetime sheet number in each of Embodiments 1 to 4 and Comparison Example 1 is shown in FIG. 14. In Embodiments 1 to 4, in either case of the plain paper ("P.P.") and the coated paper ("C.P."), the actual lifetime was longer than the estimated lifetime acquired by the remaining lifetime estimation sequence, and an error thereof was about 10-20%. On the other hand, in Comparison Example 1, in the case of the plain paper, the actual lifetime was longer than the estimated lifetime by about 40%, and in the case of the coated paper, the stick-slip noise generated earlier than the estimated lifetime by 5%.

As described above, according to Embodiments 1 to 4, the lifetime depending on the stick-slip noise of the belt 603 can be detected before the generation of the stick-slip noise, and thus it was able to be confirmed that estimation accuracy of redundancy with respect to the stick-slip noise of the belt 603 is higher than that of the conventional sheet passing number counter.

Other Embodiments (1) A device constitution in which the belt 603 is extended and stretched between a plurality of belt stretching members and is rotated by using the pressing roller 70 or one of the belt stretching members as the rotatable driving member can also be employed.

(2) Also as regards the pressing roller 70, a device constitution in which the pressing roller 70 is replaced with an endless belt-like member rotatable while sliding with a nip-forming member at an inner surface of the endless belt-like member can be employed. That is, the device constitution in which at least one of a first rotatable member 603 and a second rotatable member 70 is the endless belt-like member rotatable while sliding with the nip-forming member at the inner surface of the endless belt-like member can also be employed.

(3) In the fixing device 40 in Embodiments 1 to 4, the nip-forming member 600 is a member also functioning as the belt heating means, but the present invention is not limited to this device constitution. The belt heating means may also be disposed separately from the nip-forming member. The belt heating member can also be other heating means, having appropriate constitutions for internally or externally heating the belt 603, such as a heater provided separately from the nip-forming member, an electromagnetic induction heating means, and a halogen lamp.

(4) The image heating apparatus (device) is not limited to the fixing device for fixing the unfixed toner image on the sheet as in Embodiments 1 to 4. For example, the image heating apparatus may also be an apparatus for fixing a partly fixed toner image on the sheet or an apparatus for heating a fixed image. Accordingly, the fixing device as the image heating apparatus is, for example, a surface heating apparatus for adjusting gloss (glossiness) or a surface property of the image.

(5) The image forming apparatus which has been a printer 1 is not limited to that capable of forming a full-color image, but it may also be a monochromatic image forming apparatus. The image forming apparatus may be carried out in various uses, such as a copying machine, a facsimile machine, a multifunction machine having the function of them, or the like, which are prepared by adding necessary device, equipment and casing structure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-162560 filed on Aug. 23, 2016, which is hereby incorporated by reference herein in its entirety.

What is claimed is:

1. An image forming apparatus comprising:

an image forming portion configured to form a toner image on a recording material;

an endless belt and a roller which are configured to form a nip therebetween for fixing, on the recording material, the toner image formed by said image forming portion;

a pad configured to urge said endless belt from an inside of said endless belt toward said roller;

a motor configured to drive said roller;

an acquiring portion configured to acquire a starting torque when rotation of said roller is started and a steady-state torque after the rotation of said roller is started; and a discriminating portion configured to discriminate a lifetime of said endless belt depending on a difference between the starting torque and the steady-state torque which are acquired by said acquiring portion.

2. An image forming apparatus according to claim 1, further comprising a heater provided on said pad and configured to heat said endless belt.

3. An image forming apparatus according to claim 1, wherein said acquiring portion acquires information corresponding to the starting torque on the basis of a value of a current flowing through said motor.

4. An image forming apparatus according to claim 1, further comprising a notifying portion configured to notify of the lifetime of said endless belt discriminated by said discriminating portion.

5. An image forming apparatus comprising:

an image forming portion configured to form a toner image on a recording material;

an endless belt and a roller which are configured to form a nip therebetween for fixing, on the recording material, the toner image formed by said image forming portion;

a pad configured to urge said endless belt from an inside of said endless belt toward said roller;

a motor configured to drive said roller;

an acquiring portion configured to acquire a starting torque when rotation of said roller is started and a steady-state torque after the rotation of said roller is started; and a notifying portion configured to provide notification of prompting of exchange of said endless belt depending on a difference between the starting torque and the steady-state torque which are acquired by said acquiring portion.

6. An image forming apparatus according to claim 5, further comprising a heater provided on said pad and configured to heat said endless belt.

7. An image forming apparatus according to claim 5, wherein said acquiring portion acquires information corresponding to the starting torque on the basis of a value of a current flowing through said motor.

* * * * *